US006689180B1

(12) United States Patent
Liao

(10) Patent No.: US 6,689,180 B1
(45) Date of Patent: Feb. 10, 2004

(54) HOT AIR FLOW CONTROL DEVICE OF HEAT-SHRINKING FILM PACKAGING MACHINE

(75) Inventor: Benker Liao, Taipei (TW)

(73) Assignee: Benison & Co., Ltd., Taipei (TW)

( * ) Notice: Subject to any disclaimer, the term of this patent is extended or adjusted under 35 U.S.C. 154(b) by 0 days.

(21) Appl. No.: 10/293,287

(22) Filed: Nov. 14, 2002

(51) Int. Cl.[7] ..... B65B 53/06

(52) U.S. Cl. ..... 55/557; 53/442; 34/236; 34/211; 34/215; 34/229; 34/230; 34/231; 34/232; 34/233; 454/334

(58) Field of Search ..... 454/334; 53/557, 53/442; 34/236, 211, 215, 229–233

(56) References Cited

U.S. PATENT DOCUMENTS 3,668,817 A * 6/1972 Bell ..... 53/442
3,808,702 A * 5/1974 Laessig ..... 34/236
5,009,057 A * 4/1991 Wilkinson ..... 53/442
6,467,190 B2 * 10/2002 Nagel et al. ..... 34/229

* cited by examiner

*Primary Examiner*—Rinaldi I. Rada
*Assistant Examiner*—Michelle Lopez
(74) *Attorney, Agent, or Firm*—Rosenberg, Klein & Lee

(57) ABSTRACT

A heat-shrinking film packaging machine includes a conveyor for transporting an article to be packaged through a heating device to have a heat-shrinking film surrounding the article heated and shrunk and thus tightly packaging the article. The heating device includes a hot air flow control device including two air supply devices located on opposite sides of the conveyor to define a channel through which the article is transported. Each air supply device has a surface in which an array of openings is defined and arranged in rows and columns for supplying hot air toward the article. A blocking bar is movably mounted to the surface of each air supply device and associated with each row of the openings. The blocking bar is movable with respect to the openings to selectively and partially block the openings for controlling hot air flow through the openings. Positioning pins are formed on the surface of each air supply device and are movably received in elongate slots defined in the blocking bar for guiding the movement of the blocking bar with respect to the surface of the air supply device. Driving holes are defined in the blocking bar for manually or automatically moving the blocking bar with respect to the openings of the air supply device.

8 Claims, 7 Drawing Sheets

HOT AIR FLOW CONTROL DEVICE OF HEAT-SHRINKING FILM PACKAGING MACHINE

BACKGROUND OF THE INVENTION

1. Field of the Invention

The present invention relates generally to a heat-shrinking film packaging machine, and in particular to a device for controlling flow rate of hot air that heats and thus shrinking a plastic film for packaging articles.

2. The Related Art

Heat-shrinking plastic films have been widely used to wrap and pack consumer products, such as foods, books, video/audio compact disks for protecting the products from contamination and damage. A packaging machine is required to wrap the package film around the product and supply hot air flow to heat the plastic film in order to have the film shrink and thus securely wrap around an article to be packaged.

Since the articles or goods to be packaged with heat-shrinking films may have size and configuration significantly varied from each other. This makes uniformly heating the film surrounding the articles very difficult because while a portion of the film gets overheated and thus over-shrunk, the remaining portion of the film is still under-heated and thus under-shrunk. This leads to poor quality of packaging.

Thus, it is desired to have a device for controlling heat applying to the film in order to overcome the above problems.

SUMMARY OF THE INVENTION

An object of the present invention is to provide a hot air flow control device for a heat-shrinking film packaging machine that controls the flow rate of hot air supplied to different portions of an article packaged by a heat-shrinking plastic film so as to provide proper amount of heat to every portion of the film for high quality packaging.

Another object of the present invention is to provide a hot air flow supply device having exit ports for guiding hot air flow towards an article wrapped by a heat-shrinking film, the exit ports being selectively and partially blocked to control flow rate of the hot air through the ports.

To achieve the above objects, in accordance with the present invention, there is provided a hot air flow control device incorporated in a heat-shrinking film packaging machine for controlling the flow rate of hot air that is supplied to an article to be packaged to have a heat-shrinking film surrounding the article heated and shrunk and thus tightly packaging the article. The hot air flow control device comprises two air supply devices located on opposite sides of a conveyor that conveys the article through a channel defined by the air supply devices. Each air supply device has a surface in which an array of openings is defined and arranged in rows and columns for supplying hot air toward the article. A blocking bar is movably mounted to the surface of each air supply device and associated with each row of the openings. The blocking bar is movable with respect to the openings to selectively and partially block the openings for controlling hot air flow through the openings. Positioning pins are formed on the surface of each air supply device and are movably received in elongate slots defined in the blocking bar for guiding the movement of the blocking bar with respect to the surface of the air supply device. Driving holes are defined in the blocking bar for manually or automatically moving the blocking bar with respect to the openings of the air supply device.

BRIEF DESCRIPTION OF THE DRAWINGS

The present invention will be apparent to those skilled in the art by reading the following description of preferred embodiments thereof, with reference to the attached drawings, in which.

DETAILED DESCRIPTION OF THE PREFERRED EMBODIMENTS

Figure 1:
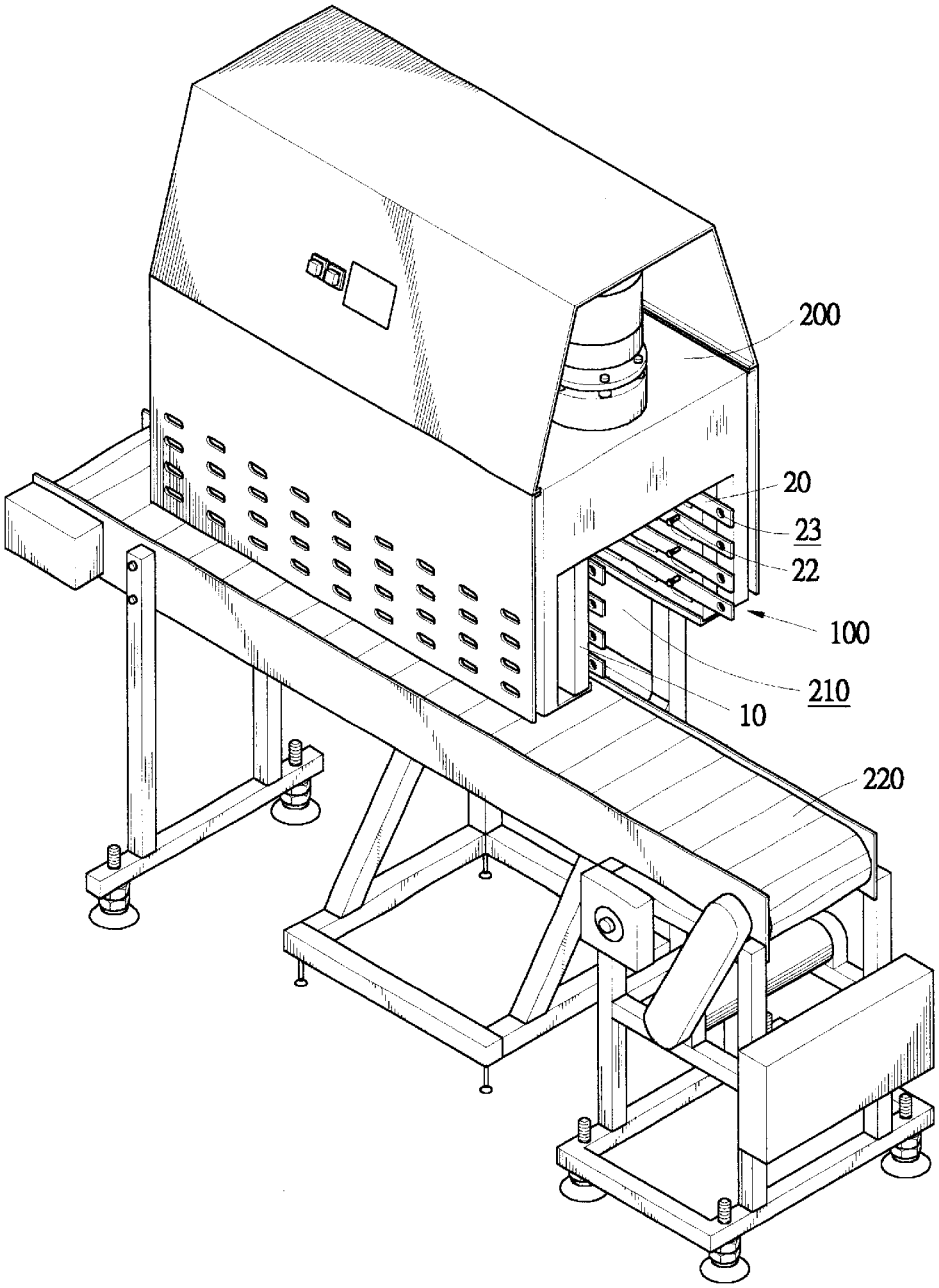
FIG. 1 is a perspective view of a heat-shrinking film packaging machine in which a hot air flow control device constructed in accordance with a first embodiment of the present invention is incorporated.
Figure 6:
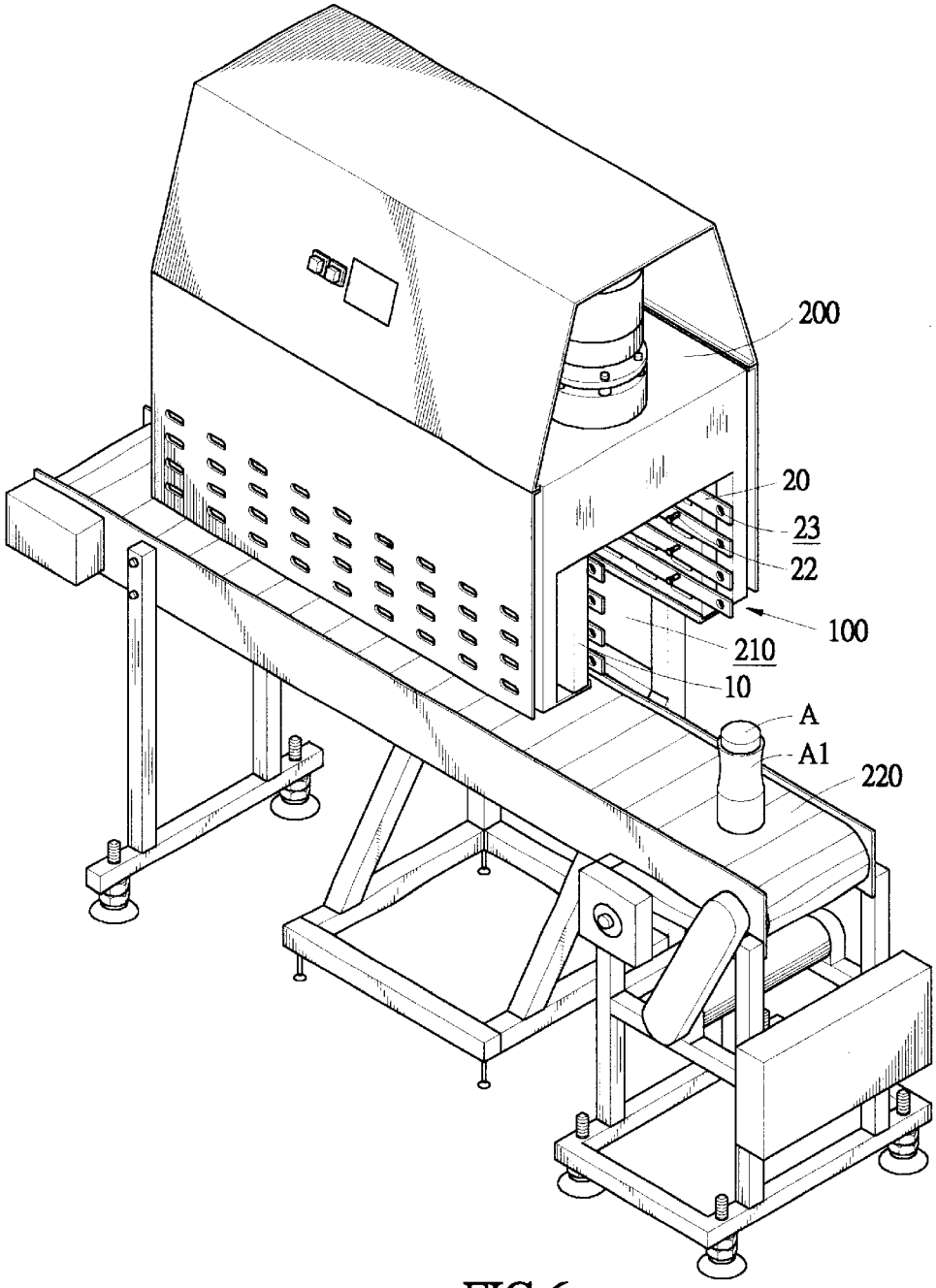
FIG. 6 is a perspective view of the heat-shrinking film packaging machine showing an article to be packaged conveyed through the packaging film.

With reference to the drawings and in particular to FIG. 1, a heat-shrinking film packaging machine comprises a conveyor 220 for conveying an article A (FIG. 6) around which a heat-shrinking film Al wraps through a heating device 200 that is generally located above the conveyor 220. A hot air flow control device 100 is arranged inside the heating device 200 and comprises two air supply devices 10 located on opposite sides of the conveyor 220 for defining a channel 210 therebetween for the pass of the article A.

Figure 2:
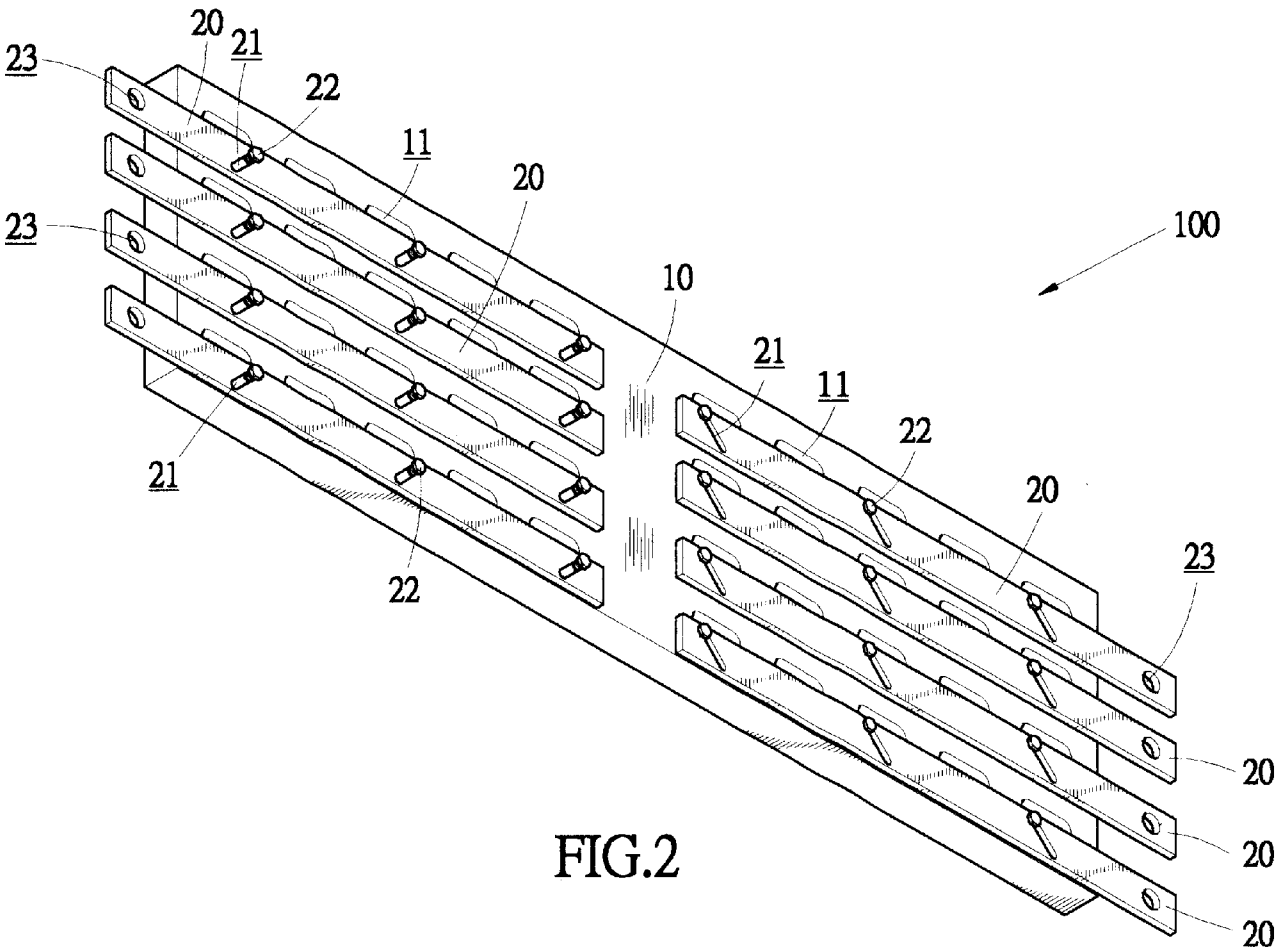
FIG. 2 is a perspective view of the hot air flow control device constructed in accordance with a first embodiment of the present invention.
Figure 3:
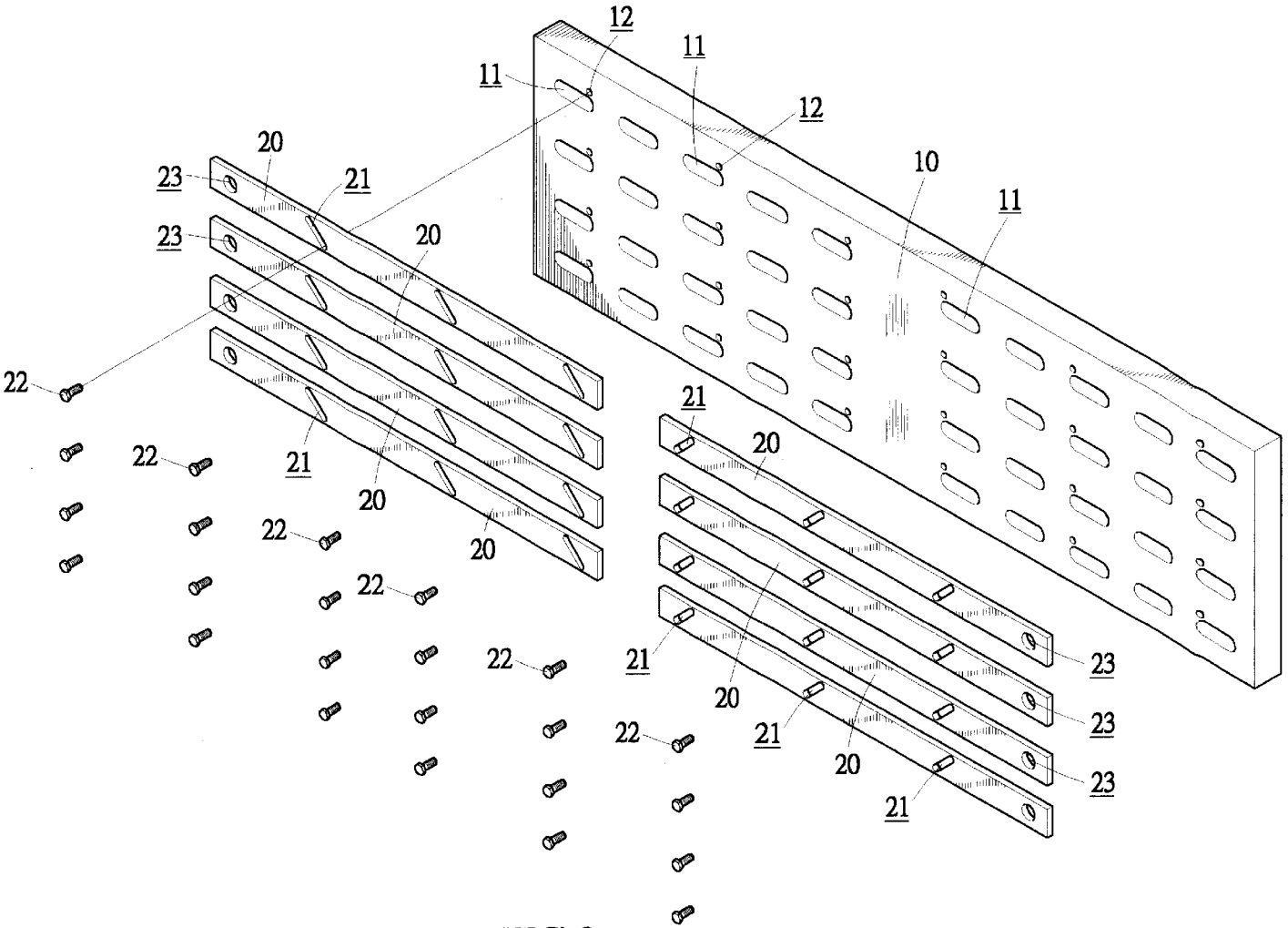
FIG. 3 is an exploded view of the hot air flow control device of the present invention.

Also referring to FIGS. 2 and 3, the air supply device 10 comprises a casing having a surface (not labeled) in which a plurality of openings 11 is defined, each serving as an air supply port. The openings 11 are connected to a hot air source (not shown) from which hot air is supplied. The hot air flows through the openings 11 toward the article A to heat the heat-shrinking film A1. In the embodiment illustrated, the openings 11 are arranged in an array having rows (extending horizontally) and columns (extending vertically). It is noted that the direction of the row is substantially corresponding to the moving direction of the article A that is conveyed by the conveyor 220. The openings 11 may assume any shape, such as an elongate oval shape extending in the direction of the row (the horizontal direction) as illustrated in the drawings. A plurality of holes 12 is formed in the surface of the air supply device 10.

A number of blocking bars 20 having a length sufficient to cover a given number of openings 11 in a row are movably mounted to the surface of the air supply device 10. Each blocking bar 20 defines a plurality of elongate slots 21 that are inclined with respect to the direction of the row. Each slot 21 movably receives a bolt 22 engaging with a corresponding one of the holes 12 for movably attaching the blocking bar 20 to the air supply device 10. The slots 21 are sized to allow the bolts 22 to move along the slots 21. Thus, the blocking bars 20 are allowed to move with respect to the air supply device 10.

Each blocking bar 20 is provided with driving holes 23 which is selectively coupled to a driving device for automatically or manually moving the blocking bar 20 with respect to the air supply device 10.

Figure 4:
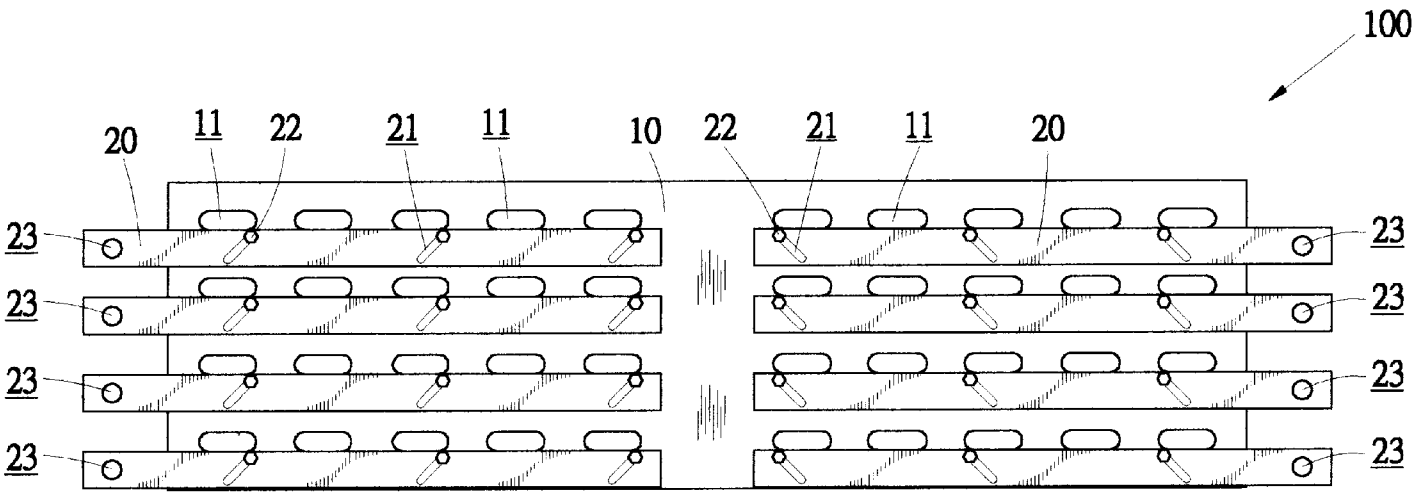
FIG. 4 is a plan view of the hot air flow control device of the present invention in a fully open condition.
Figure 5:
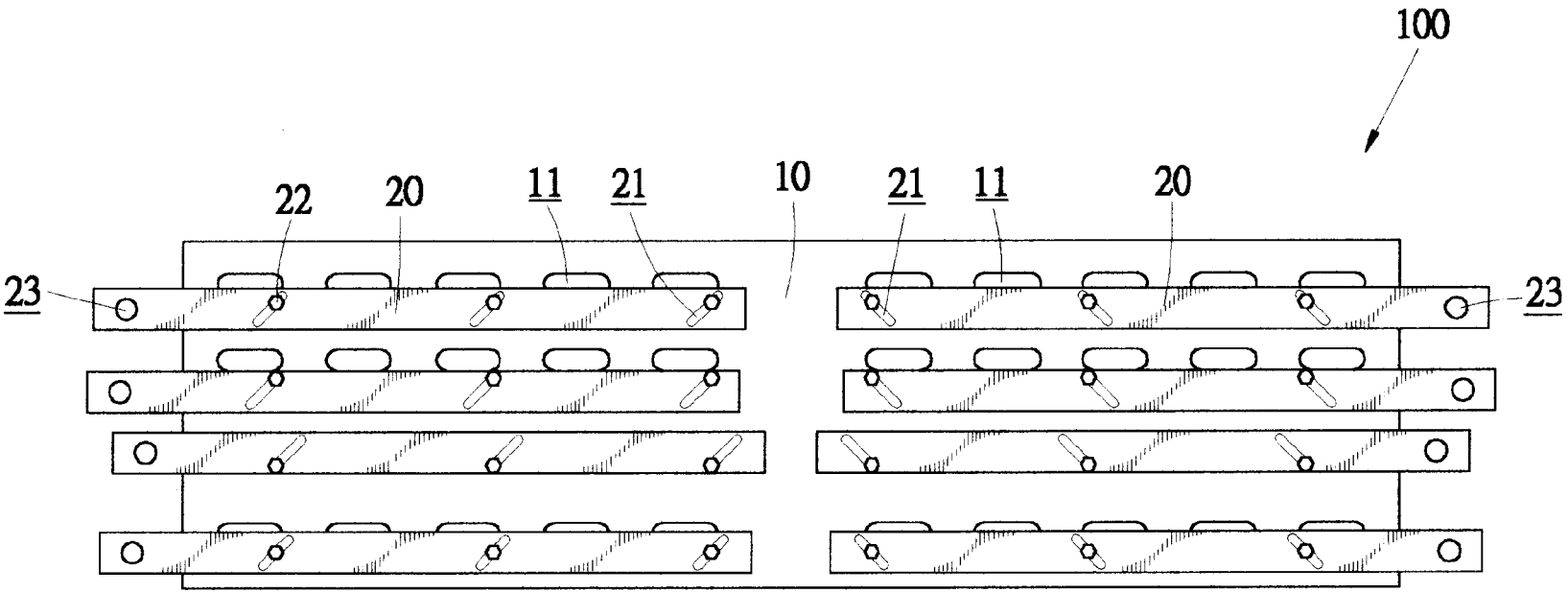
FIG. 5 is a plan view similar to FIG. 4 but showing the hot air flow control device of the present invention in a partially closed condition.

Also referring to FIGS. 4 and 5, the blocking bars 20 are sized to completely block the openings 11 of the air supply device 10. The slots 21 are dimensioned and positioned to allow the blocking bars 20 to move completely off the openings 11 as shown in FIG. 4. The blocking bars 20 are selectively driven to partially block the openings 11 associated therewith so as to control the hot air flow therethrough as shown in FIG. 5. Thus, an operator may adjust the position of each blocking bar 20 with respect to the openings 11 associated therewith to selectively and partially block the openings 11 in order to control hot air flow supplied to different portions of the article A.

Figure 7:
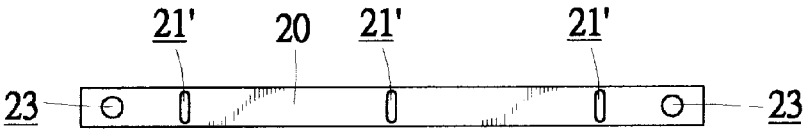
FIG. 7 is a plan view of a blocking bar of the hot air flow control device constructed in accordance with a second embodiment of the present invention.

FIG. 7 shows a blocking bar 20 constructed in accordance with a second embodiment of the present invention in which slots 21' extending in a direction substantially perpendicular to the row of the openings 11 associated therewith are defined. Namely, the slots 21' extend vertically. The direction of the slots 21' allows the blocking bar 20 to be moved by means of the driving holes 23 in the vertical direction perpendicular to the row of the openings 11 thereby selectively and partially blocking the openings 11.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A hot air flow control device for a heat-shrinking packaging machine, comprising:

at least two air supply devices spaced from each other to define therebetween a channel adapted to allow an article to be packaged to pass, each air supply device having a surface in which at least one row of openings is defined and arranged along a first direction for supplying hot air toward the article; and a blocking bar movably mounted to the surface of each air supply device, the blocking bar being movable with respect to the surface in at least a second direction transverse to the first direction to selectively and partially block the openings for controlling hot air flow through the openings;

one of the surface and blocking bar having formed therein at least one elongate guide slot, and the other of the surface and blocking bar having formed thereon at least one positioning pin maintaining slidable engagement with the guide slot.

2. The hot air flow control device as claimed in claim 1, wherein the slots extend in the second direction to be inclined with respect to the first direction.

3. The hot air flow control device as claimed in claim 1, wherein the slots extend in the second direction to be substantially perpendicular to the first direction.

4. The hot air flow control device as claimed in claim 1, wherein the openings are of elongate oval shape extending in the first direction.

5. The hot air flow control device as claimed in claim 1 further comprising driving means for moving the blocking bar with respect to the surface of the air supply device.

6. The hot air flow control device as claimed in claim 5, wherein the driving means comprises at least a hole defined in the blocking bar.

7. The hot air flow control device as claimed in claim 1, wherein the surface of each air supply device defines a plurality of openings arranged in rows and columns, a blocking bar being movably mounted to the surface associated with each row for selectively and partially blocking the openings of the row.

8. The hot air flow control device as claimed in claim 1, wherein the positioning pins comprise bolts received and fixed in holes defined in the surfaces of the air supply devices.

* * * * *